US009190224B2

(12) United States Patent
Polak

(10) Patent No.: US 9,190,224 B2
(45) Date of Patent: Nov. 17, 2015

(54) ROTARY SWITCH WITH PUSH FUNCTION

(75) Inventor: Andrzej Polak, Huerth (DE)

(73) Assignee: Delphi Technologies, Inc., Troy, MI (US)

( * ) Notice: Subject to any disclaimer, the term of this patent is extended or adjusted under 35 U.S.C. 154(b) by 236 days.

(21) Appl. No.: 13/983,333

(22) PCT Filed: Jan. 27, 2012

(86) PCT No.: PCT/EP2012/051331
§ 371 (c)(1),
(2), (4) Date: Aug. 2, 2013

(87) PCT Pub. No.: WO2012/110297
PCT Pub. Date: Aug. 23, 2012

(65) Prior Publication Data

US 2013/0306447 A1 Nov. 21, 2013

(30) Foreign Application Priority Data

Feb. 15, 2011 (EP) ..... 11154571

(51) Int. Cl.
*H01H 19/11* (2006.01)
*H01H 1/16* (2006.01)
*H01H 3/08* (2006.01)
*H01H 25/06* (2006.01)
*H01H 3/12* (2006.01)

(52) U.S. Cl.
CPC . *H01H 3/08* (2013.01); *H01H 3/12* (2013.01); *H01H 25/06* (2013.01)

(58) Field of Classification Search
CPC ..... B60K 2350/102; B60K 37/06
USPC ..... 200/318.1, 318.2
See application file for complete search history.

(56) References Cited

U.S. PATENT DOCUMENTS

| | | | | |
|---|---|---|---|---|
| 5,860,774 | A * | 1/1999 | Teper | 408/108 |
| 6,067,424 | A * | 5/2000 | Shono | 396/297 |
| 6,225,580 | B1 * | 5/2001 | Lemire | 200/11 DA |
| 7,109,469 | B2 * | 9/2006 | Hayashi | 250/221 |
| 7,368,673 | B2 * | 5/2008 | Sato | 200/5 R |
| 7,476,822 | B2 * | 1/2009 | Miura et al. | 200/564 |
| 2002/0003082 | A1 * | 1/2002 | Janniere et al. | 200/6 A |
| 2004/0154910 | A1 | 8/2004 | Hayashi | |
| 2007/0029427 | A1 * | 2/2007 | Morise | 242/317 |
| 2010/0147665 | A1 * | 6/2010 | Huang et al. | 200/336 |

FOREIGN PATENT DOCUMENTS

| | | |
|---|---|---|
| EP | 1 555 684 A1 | 7/2005 |
| GB | 584 764 A | 1/1947 |

OTHER PUBLICATIONS

International Search Report dated Mar. 12, 2012.

* cited by examiner

*Primary Examiner* — Renee S Luebke
*Assistant Examiner* — Ahmed Saeed
(74) *Attorney, Agent, or Firm* — Lawrence D. Hazelton

(57) ABSTRACT

A switch assembly that includes the coaxial assembly of a cylindrical core extending from a base to a distal end, an outer knob rotatable about the core, a switching means generating an electrical signal dependent on the rotations of the knob, and a guiding means for guiding the knob in its motions relative to the core. The guiding means includes an upper-guide in the vicinity of the core-end and the knob-top, and a lower-guide in the vicinity of the core-base and the knob-base. The upper-guide includes elements rolling between an upper-guide inner race integral to the core and an upper-guide outer race integral to the knob.

9 Claims, 8 Drawing Sheets

P1 REST POSITION

P2 PUSHED POSITION

P1 REST POSITION

P2 PUSHED POSITION

ROTARY SWITCH WITH PUSH FUNCTION

CROSS-REFERENCE TO RELATED APPLICATION

This application claims the benefit under 35 U.S.C. §371 of published PCT Patent Application Number PCT/EP 2012/051331, filed Jan. 27, 2012, claiming priority to European patent application number EP 11154571.1 filed on Feb. 15, 2011, and published as WO2012/110297 on Aug. 23, 2012, the entire contents of which is hereby incorporated by reference herein.

TECHNICAL FIELD OF INVENTION

The present invention relates to a multifunctional switch with an indicator, in which a plurality of functions can be selected and validated through a rotation and a push of a dial knob.

BACKGROUND OF INVENTION

Rotary switch of the aforementioned type exists and are commonly implemented in automotive environment for instance to control the air conditioning or a Hi-Fi system.

Said switches are typically built on an electronic printed circuit board (PCB). A tubular cylindrical core is fixed on the PCB, and serves as a primary guide for a bushing that is placed over said cylindrical core. An external rotary knob, accessible to an operator, is placed over the bushing. The switch is in mechanical and electrical connection with the PCB and the rotation of the knob selects various functions. Furthermore, similarly to a key on a computer key board, a function chosen by rotation can be validated by a push on the knob, which then axially slides on the bushing toward the PCB and commutes an electrical switch. An elastic mean, such as a coil spring, biases the knob away from the pushed position, where a function has been validated, back to an extended position, when not pressed by the operator. To help the operator in the function selection, a liquid crystal display (LCD) may be fixed on the core while the knob remains open or provided with a transparent window in order to leave a visual direct access to the LCD. A back illumination of the LCD is made possible as the hollow center of the cylindrical core is a light channel for a light beam generated by a light source, typically a light-emitting diode (LED) fixed on the PCB.

In EP1555684, Kikuya et al. disclose such a rotary switch. This and other switches of the same type have been successfully implemented in diverse environments including inside many vehicles. In US2004/0154910, Hayashi discloses a rotary switch having a knob guided on a fixed cylindrical core between the lower portion of the core on which the knob slides and, the upper portion of the core where a set of balls maintained in individual radial cavities are radially pressed by springs against the knob's inner cylindrical surface. Consequently to this arrangement, each ball slides between the surfaces of the knob, of the cavity and the final turn of the spring.

Unfortunately all these switches suffer from characteristics inherent to their structure. Indeed, the sliding of the knob and of other elements result in an unpleasant friction feeling perceived by the operator. Furthermore, said friction goes against a desired accuracy of the positioning of the knob. Even though the switch may be provided with an indexing feature, the friction generates a need to manually slightly adjust the angular position of the knob. Also, after being pushed to validate a function, the friction acts against a self-return of the knob in the extended rest position. In an attempt to minimize the friction, the functional gap between the knob and the bushing has to be increased above the mandatory minimum required to accommodate the manufacturing tolerances. Consequently, under small lateral forces, the knob is subject to a very unpleasant little wobble perpendicular to the rest-pushed direction. This increases the perceived feeling of inaccuracy.

It is important to propose to the market a rotary switch having a push function that is solving aforementioned problems in having the desired wobble-free precise and accurate motion of the knob.

SUMMARY OF THE INVENTION

In carrying out the above object and other objects, features of the present invention provide a switch assembly according to the characteristics' of claim 1.

The switch assembly comprises the coaxial assembly along a longitudinal axis of a cylindrical core, axially extending from a base to a distal end, the core-base being fixed to a base plate, an outer knob, extending from a knob-base to a distal knob-top, the knob being axially rotatable about the core, a switching mean generating an electrical signal dependent on the rotations of the knob, and a mean for guiding the knob in its motions relative to the core. Said mean comprises an upper-guide, in the vicinity of the core-end and the knob-top, and a lower-guide in the vicinity of the core-base and the knob-base. The upper-guide comprises rolling elements, said elements rolling between an upper-guide inner race integral to the core, and an upper-guide outer race integral to the knob. Thanks to this upper bearing arrangement, the rotations of the knob are advantageously friction-free.

The outer race is truncated with upward apex and the switch assembly further comprises a mean for generating an upward axial force biasing the rolling elements onto the upper-guide outer race. This advantageously eliminates any free play that would be detrimental to the tactile feeling when operating the knob.

The lower-guide may as well comprise rolling elements, said elements rolling between a lower-guide inner race integral to the core, and a lower-guide outer race integral to the knob. The lower-guide outer race is truncated with downward apex and the switch assembly further comprises a mean for generating a downward axial force biasing the rolling elements onto the lower-guide outer race. Thanks to this bearing-like arrangement for the lower guide symmetrical to the upper guide, undesirable friction is eliminated in the motion of the knob.

The means for biasing the rolling elements are placed between the upper-guide and the lower-guide and are equally pushing apart said guides in opposite axial directions. This advantageously reduces the number of components by combining the means for biasing, in using a single mean that serves both purposes for the upper guide and for the lower guide.

To avoid misalignment of the upper and the lower guide, a mean maintaining them in coaxial alignment is provided.

The switch assembly further comprises a mean for indexing the rotation of the knob. This mean comprises an indexing member biased by an elastic member against an indented path integral to the knob. The indexing member is linked to the base. A symmetrical mounting with the indented path integral to the base and the indexing member is linked the knob is possible. This advantageously keeps the knob in position when not operated.

The knob is further able to axially translate relative to the core between a first position and a second position. The mean for guiding the knob in its motions relative to the core guides the knob when it translates. Another switching mean generating another electrical signal dependent on the translation of the knob is provided. This, for instance, enables to validate functions.

The switch assembly further comprises another mean generating a unidirectional axial force onto the knob forcing said knob to return into the first position after being displaced from said first position. This keeps the knob in the first position when it is not operated. Said mean for generating a unidirectional axial force comprises the indented path and the indexing member. The indents of the indented path are operated in a groove having two symmetrical sides. In the first position, the indexing member is biased in the bottom of the groove generating on the knob symmetrical and balanced upward and downward forces. The knob is at equilibrium. When away from the first position, the indexing member travels on one side of the groove generating on the knob the unidirectional force that forces the knob to return to the first position.

Furthermore, the knob-top is open or provided with a transparent mean leaving visual access to a display, fixed on the core-end. Also, to improve the visibility of the display, the core is tubular and its the hollow center is a light channel for a light beam generated by a source. The light beam back illuminates the display.

BRIEF DESCRIPTION OF DRAWINGS

The present invention is now described by way of example with reference to the accompanying drawings in which.

DETAILED DESCRIPTION

In the following description, similar elements could be designated with the same reference numbers.

In a motor vehicle an operator can control a function by manipulating the knob of a switch assembly 10. Thanks to a bearing-like arrangement, the knob 12 of the switch assembly 10 of the present invention has rotary and push capabilities. It thus enables function selection and function validation. The rotation may be limited to a certain angular sector or may be end-less. The translation is typically limited to a commutation between an extended rest position P1 and a pushed active position P2. Other choices are of course possible such as three or more translation positions with intermediates between a full extended position and a full pushed position.

The description focuses on a particular embodiment of the invention and alternatives are briefly mentioned without any intention to limit the scope of the invention to these specific embodiments.

Figure 1:
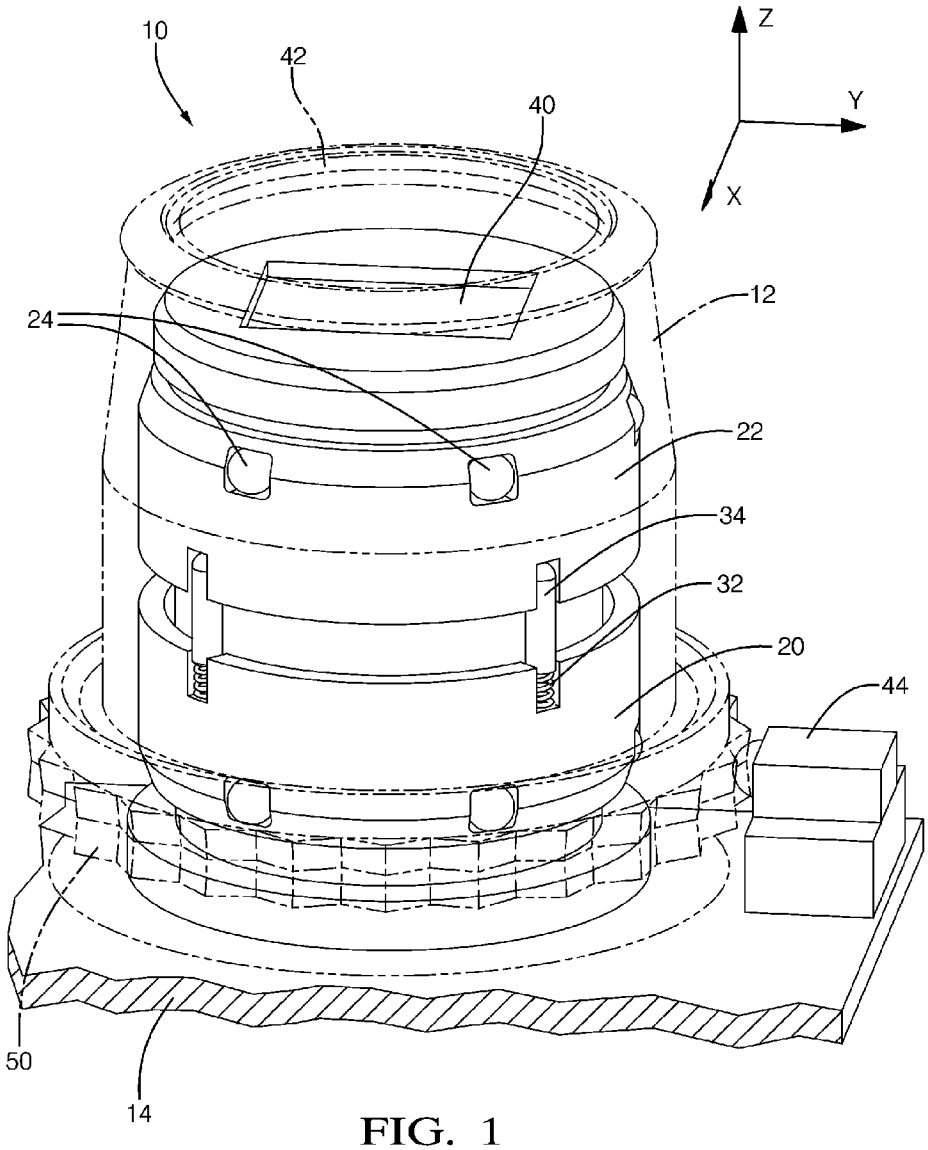
FIG. 1 is a perspective view of a switch assembly as per the invention.

The description will use a tri-orthogonal direct coordinate system (X, Y, Z) as shown in FIG. 1. For clarity and concision purposes, and to ease the understanding, a bottom-up orientation as shown on the Figs. will also be used. Therefore, the terms low, high, over, under, superior, inferior, above, below, top, bottom, horizontal, vertical, downward and upward may be utilized without any intention to limit the scope of the invention, especially in regards of the numerous possibilities of installation of the switch assembly in a vehicle. The plan (X, Y) is then described as the horizontal plan and the axis Z is the vertical axis normal to the horizontal plan.

The perspective and semi-transparent FIG. 1 enables to identify, to position and to understand the function of the key constituents that will be described afterward in greater details.

Figure 2:
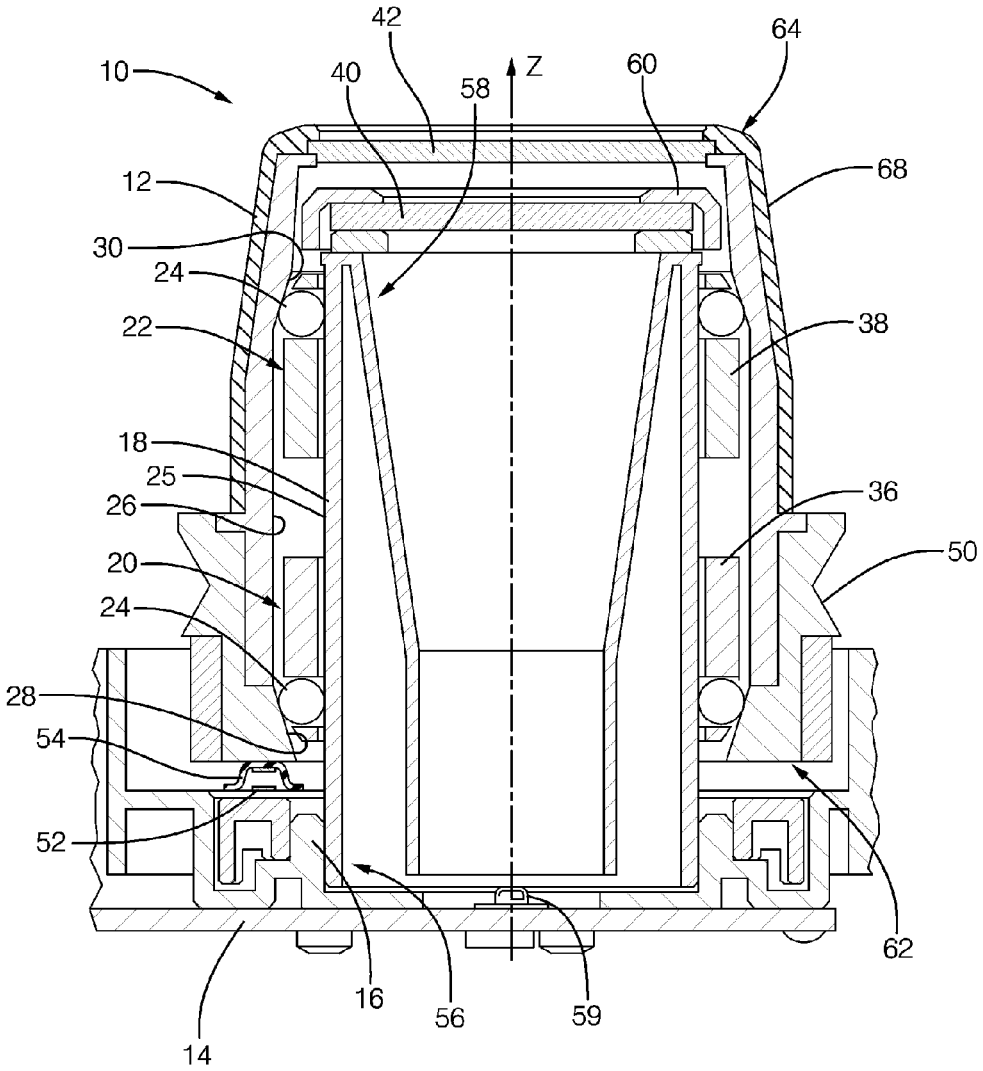
FIG. 2 is a section of the switch of FIG. 1, the section being in a vertical plan passing through rolling elements, the switch being in rest position.
Figure 3:
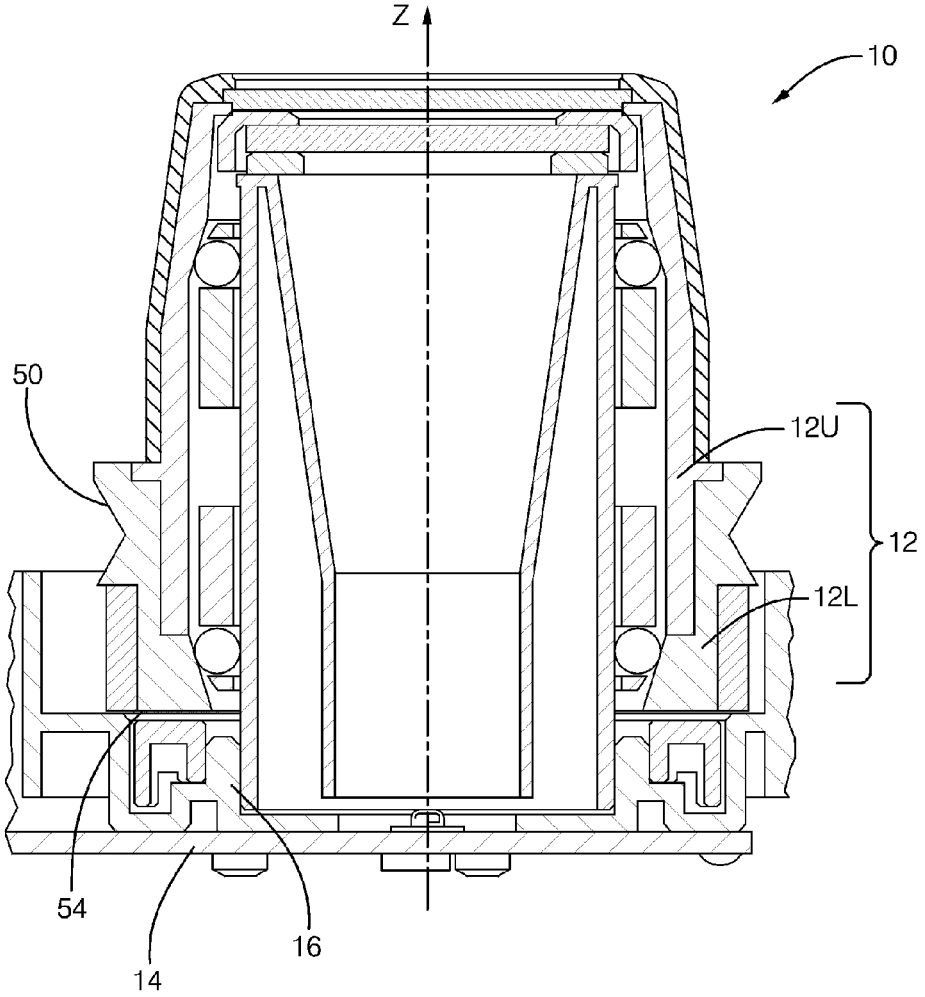
FIG. 3 is the same section as in FIG. 2, the switch assembly being in pushed position.

On a base plate 14 that may eventually be a printed circuit board (PCB) is fixed a support 16 wherein a cylindrical core 18 is received and fixed. Said core 18 vertically extends as a cylinder—FIG. 2. Over the core 18 are placed a lower bearing 20 and an upper bearing 22, both having balls 24 in contact with the core's cylindrical surface 25, thus constituting the inner race for the bearings 20, 22. The knob 12 coaxially covers the bearings 20, 22. The knob 12 has an internal surface 26—FIG. 2—comprising two truncated sectors 28, 30, oppositely oriented and constituting the respective outer race of the bearings 20, 22. To eliminate any internal free play that would be detrimental to the tactile feeling, the bearings 20, 22, are aligned and pre-loaded thanks to a plurality of springs 32 and pins 34 interposed between the respective cages 36, 38, of the bearings 20, 22. The balls 24 are thus biased against their respective outer race 28, 30.

The switch assembly 10 further comprises a liquid crystal display (LCD) 40, or any other type of display, fixed on the top of the core 18. A transparent window 42 is fixed on the top of the knob 12 enabling the operator to see the information displayed on the LCD 40. An alternative to a transparent window may be to leave open the top of the knob 12. The core 18 is tubular and its hollow center 43 is a light channel for the back illumination of the display 40.

Furthermore, an indexing device 44 is provided. It comprises an index 46—FIG. 4—horizontally biased onto an indented peripheral sector 50 of the knob 12. While the index 46 is maintained in a recess of the support 16, the indented sector 50 moves with the knob 12. Additionally to providing rotational indexing, the indexing device 44 automatically generates an upwardly oriented force F when the knob 12 is pushed down. The force F biases the knob 12 back up and maintains it in the rest position P1.

The PCB 14 and the switch assembly 10 are also provided with all necessary electrical equipment, for instance in order to wire the LCD 40 or to capture the motions, rotation and push, of the knob 12. When an operator pushes the knob 12 an electrical switch 52 is commuted. To enhance the tactile feeling and generate a pleasant more sudden vertical force felt by the operator, one or more deformable silicone domes 54 are typically placed over, or next by, the electrical switch 52 and are pressed when the electrical switch 52 commutes.

FIGS. 2 to 6 detail the structural embodiment of the switch assembly 10. On the horizontal PCB 14 is fixed the support 16 that is provided with a hole having a peripheral wall fitted to receive and to fix the cylindrical core 18 that upwardly extends from its base, the "core-base" 56 to its distant end, the "core-end" 58. The core 18 further comprises the inner light channel 43 that has a cylindrical bottom continued by a truncated portion integral to the core-end 58. Other shapes of the light channel 43 are possible such as a continuous cone or a continuous cylinder. In a preferred embodiment represented on the Figures, the light channel and the cylindrical core are molded in one piece. A multi-piece process is possible, said pieces being fixed together afterward. The LCD 40 is horizontally fixed to the core-end 58 and is electrically connected to the PCB 14 via wires (not shown) preferably arranged between the light-channel 43 and the cylinder. The LCD 40 is back lighted thanks to a light-emitting diode (LED) 59, or any other light-emitting device, connected on the PCB 14 substantially in the center of the support's hole. The light-channel 43 upwardly conducts the light beam to the LCD 40 providing backlightion. Alternatively to the LCD 40, other type of display may be chosen, such a simple window where an icon would be drawn.

The preferred way for fixing the core 18 to the PCB 14 is, as shown, via the core-base 56 in the support's hole where it may be glued or fixed using any known process. Alternatively, the fixation may be operated otherwise, for instance, directly from the core-base 56 to the PCB 14 or even via the bottom of the light-channel 43 to the PCB 14. At the other extremity of the core 18, the fixing of the LCD 40 on the core-end 58 is presented on the FIGS. 2-5 using a mechanical flange 60. It may alternatively be done using any other known fixing process such as gluing or crimping.

The knob 12 is coaxially assembled over the core 18 and it extends from its base, the "knob-base" 62 that is slightly above the PCB 14, to its top, the "knob-top" 64 that is over the core-end 60. While the knob's external surface is shown cylindrical, it may take any other shape and may be covered with a layer of material 68 easing the handling and fine manipulation for tuning. Inside of the knob 12, the truncated section 28 has its apex A1—FIG. 6—downwardly oriented and the upper truncated 30 section has its apex A2 upwardly oriented. In between the truncated sections 28, 30, the knob's inner surface 26 is cylindrical.

The upper and lower bearings 22, 20, are placed between the core 18 and the knob 12. As can be seen on the FIGS. 2 and 3, the balls 24 of the bearings 20, 22, contact the external cylindrical surface 25 of the core 18 and the truncated sectors 28, 30, of the inner surface 26 of the knob 12. The set of balls 24 of any of the two bearings 20, 22, is maintained in a horizontal plan spatially positioned on a circle thanks to the cages 36, 38, that are provided with recesses 70—FIGS. 7 and 8. Within each recess 70 is placed one ball 24. Preferably but not mandatory, and in order to ease the manufacturing process, the upper and lower bearings 20, 22, are made identical then are mounted head to tail in the switch assembly 10. Each bearing 20, 22, comprises six balls 24 equally distributed every 60 degree. The balls 24 of the bearings 20, 22, are vertically aligned by pair. Within their respective recesses 70, the balls 24 are maintained preferably free, the width and height of the recess 70 being very slightly larger than the diameter of the ball 24. Alternatively the ball 24 can be maintained with a very little press fit.

In a first embodiment, presented on the FIGS. 1 to 7, each recess 70 consists in a four walls window within which a ball 24 is placed by push it in a radial direction.

Figure 8:
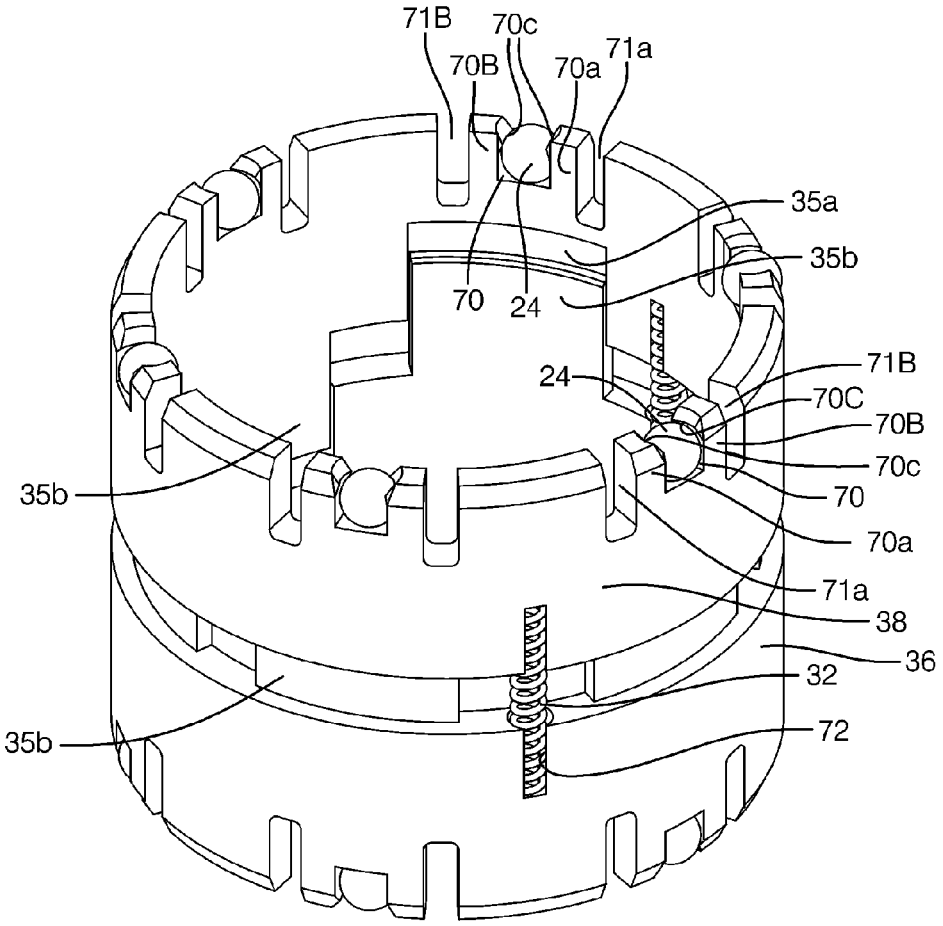
FIG. 8 is a detail in perspective of the guiding elements as per a second embodiment of the present invention.

In a second embodiment, presented on FIG. 8, each recess 70 has only three walls and is open in the vertical direction Z. The ball 24 is placed between the two lateral walls 70*a*, 70*b*. On both side of the recess 70 is operated a vertical slot 71*a*, 71*b*, so that the side walls 70*a*, 70*b*, are indeed lugs extending in the vertical direction Z from a base to a distal extremity. Thanks to this, the side walls 70*a*, 70*b*, are provided with a little elasticity enabling a little angular motion about a radial axis passing through the base of the lug. At their distal extremity, the side walls 70*a*, 70*b*, are provided with a snap-on feature 70*c* that brings the walls 70*a*, 70*b*, closer to each other than they are by the main part of the recess 70. The ball 24 is put in place by pressing the ball 24 in the vertical Z direction between the distal extremities of the walls 70*a*, 70*b*, over the snap-on feature 70*c*. Thus, the walls 70*a*, 70*b*, give way thanks to the elasticity provided by the slots 71*a*, 71*b*. When the ball 24 has passed the snap-on feature 70*c*, it gets into the main part of the recess 70 and consequently the walls 70*a*, 70*b*, get back in their vertical position capturing the ball 24 in the recess 70. The ball 24 is free between the three walls of said recess 70. A feature prevents the ball 24 to fall off the recess 70 in the radial direction. Such a feature can easily be arranged thanks, for instance, to a non-straight cross section of the window observed in a horizontal plane. A cylindrical cross section is one of the multiple possibilities that would prevent the ball 24 to fall of the window 70, while still being free when in place.

In further alternative embodiments, differences between the bearings could be arranged, such as in the size or number of the balls or the making of the cages. Furthermore, the bearings are represented and described as ball bearings. Alternatively, the rolling elements may be rollers which axis would intersect by the apex of the outer races. Rollers may provide larger contact area with their inner and outer races and, considering that most of the time the knob does not move, this may help in avoiding local indents in the races.

The functioning of the switch assembly 10 is optimized as the bearings 20, 22, are maintained coaxially aligned and are pre-loaded.

In the FIGS. 1 to 7 a first embodiment is presented. It eases the process and minimizes packaging. Each of the bearing's cage is provided with a plurality of vertical slots. Each slot in the upper bearing 22 faces a slot in the lower bearing 20 thus creating pairs of slots. In each pair is placed a vertically acting spring 32 biasing a vertical pin 34. As detailed on the FIG. 7, the spring 32 placed and maintained in a slot 72 of the lower cage 36, the "lower-slot" 72, is associated to a pin 34 placed, in the slot 74 of the upper cage 38, the "upper-slot" 74. The pin 34 downwardly extends from the upper-slot 74 into the lower-slot 72 where it compresses the spring 32 that generates a counter force. In the lower-slot 72, the pin 34 is not fixed. This enables vertical motion of the lower-cage 36 relative to the upper-cage 38. Consequently, on one side the pins 34 align the cages 36, 38, by linking them to each other and enabling vertical relative motion and, on the other side the pre-loading is operated as the springs 32 bias the pins 34 and therefore push the bearings 20, 22, apart in opposite directions. Also, other alternative embodiments can be imagined and are not fully described. For instance the pins 34 represented as separate parts, could be molded integral with the upper cage.

Figure 7:
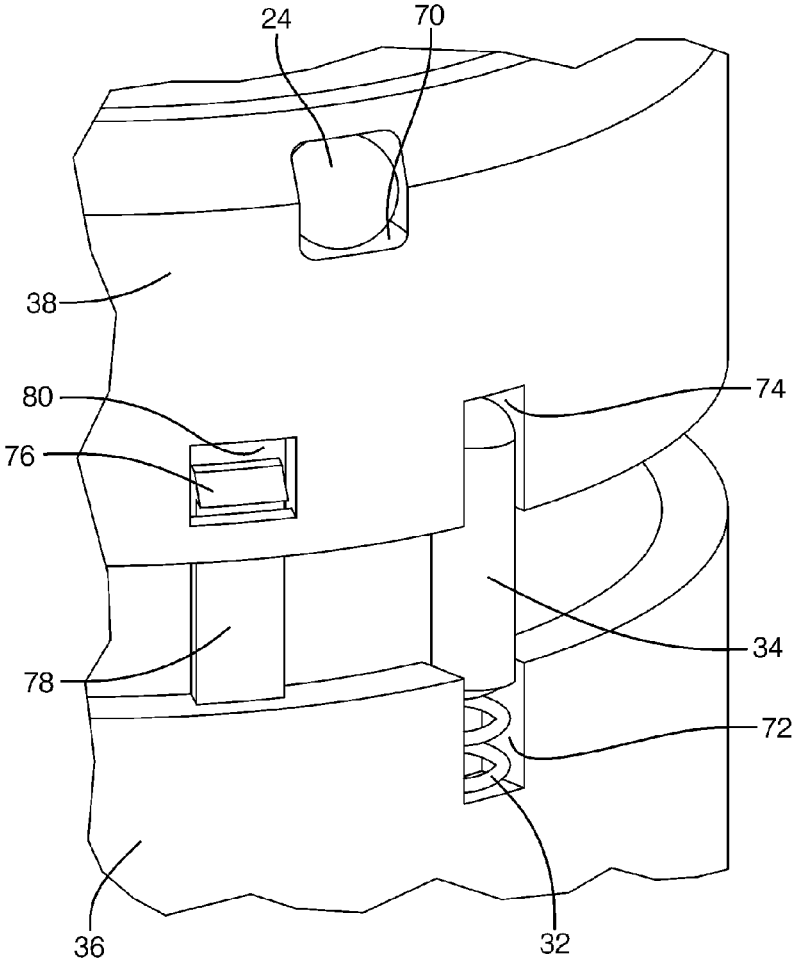
FIG. 7 is a detail view of a ball and of the guiding element as per a first embodiment of the present invention.

As shown on FIG. 7, a clipping device 76 keeping the bearings 20, 22, together eases the assembly. The clipping device 76 comprises a lug 78 upwardly extending from the lower cage 36 and engaging and clipping into a window 80 of the upper cage 38. Multiple other arrangements easing the assembly may be developed. What is important is that the device 76 does not prevent the motion of the cages 36, 38, relative to each other.

In a second embodiment detailed in FIG. 8, the coaxial alignment and the pre-load are provided separately in non-combined devices.

The coaxial alignment is ensured by having each cage 36, 38, provided with three undercuts 35*a* alternating with three extensions 35*b* regularly distributed about the vertical Z axis. Assembled head to tail, each cage 36, 38, presents each of its undercuts 35*a* to an extension 35*b* of the other cage 38, 36, for complementary engagement. As shown on FIG. 8, the undercuts 35*a* are female undercuts partially and locally reducing the wall thickness of the cages 36, 38, on a horizontal angle and a vertical height. The extensions 35*b* are male arcuate lugs vertically extending and having dimensions set for complementary engagement with the slots 35*a*.

Dimensionally, FIG. 8 represents an arrangement alternating undercuts and extensions having on an angle of approximately 45 degrees followed by a complementary horizontal portion of 15 degrees that joins an undercuts 35*a* to an extension 35*b*. The vertical height of the undercuts 35*a* and extensions 35*b* is preferably, but not mandatory, limited by the recess 70.

In the second embodiment represented on FIG. 8, the preloading is ensured by three coil springs 32 vertically pushing apart the cages 36, 38, in opposite directions. Each cage is provided by vertical slots 72 operated in the horizontal portions that join the undercuts 35*a* to the extensions 35*b*. To have the cages 36, 38, manufactured identical, which is not mandatory, the slots 72 should be in the middle of the horizontal portions so that, when presented head to tail for complementary engagement of undercuts and extensions, the slots 72 would constitute aligned pairs wherein the springs 32 would be placed.

The second embodiment of FIG. 8 does not have clipping device 76 similar to what is represented in FIG. 7 for the first embodiment. Nevertheless, a clipping device 76 can easily be adapted to the second embodiment. For instance by having a similar arrangement of lug 78 and window 80 placed on the horizontal portion joining the undercuts and the extension where there is no spring 32. Another possibility is to provide the undercuts 35*a* with portion that would be deeper, or even would constitute a through window, in which would clip the complementary extension 35*b*. In anyway, said clipping should not prevent the vertical relative motion of the cages 36, 38.

FIG. 8 shows the three undercuts and the three complementary extensions on the inner side of the cages. Obvious alternatives are possible, such as a similar device on the outer side of the cages. Also, another angular arrangement for the undercuts and extensions or another number of undercuts and extensions is possible.

Whatever the embodiment is, when assembled, the balls 24 of the upper bearing 22 are biased upward in contact against the upper truncated surface 30 of the knob 12 and, symmetrically, the balls 24 of the lower bearing 20 are biased downward in contact against the lower truncated surface 28 of the knob 12, said knob 12 being able to rotate and to translate about the axis Z.

When the knob 12 is rotated, the ball 24 rotates between the inner race 25 and the truncated outer race 28, 30. The balls 24 push the cages 36, 38, in rotation about the vertical Z axis at half the rotation speed of the knob 12. In this motion, in order to push the cages in rotation, the balls 24 are in sliding contact with a side wall 70*a*, 70*b*, of the recess 70.

An optimal functioning of the switch assembly 10 is ensured by an optimum dimensioning of all components where, under nominal conditions, the cages are able to axially move relative to each other and also, the balls 24 are in contact with their respective outer races 28, 30, in the middle of the truncated surface and also, that the load is evenly distributed over all the balls 24. Also, the rotation of the ball 24 between the inner race 25 and its outer race 28, 30, should in no way be prevented by the minor sliding against a side wall 70*a*, 70*b*.

As shown on the FIGS. 2-5, to ease the manufacturing and the assembly of the switch 10 the knob 12 may be manufactured in distinct upper 12U and lower parts 12L, thereafter integrally fixed. The lower part 12L comprises the lower truncated surface 28 and the upper part 12U comprises the upper truncated surface 30.

Figure 4:
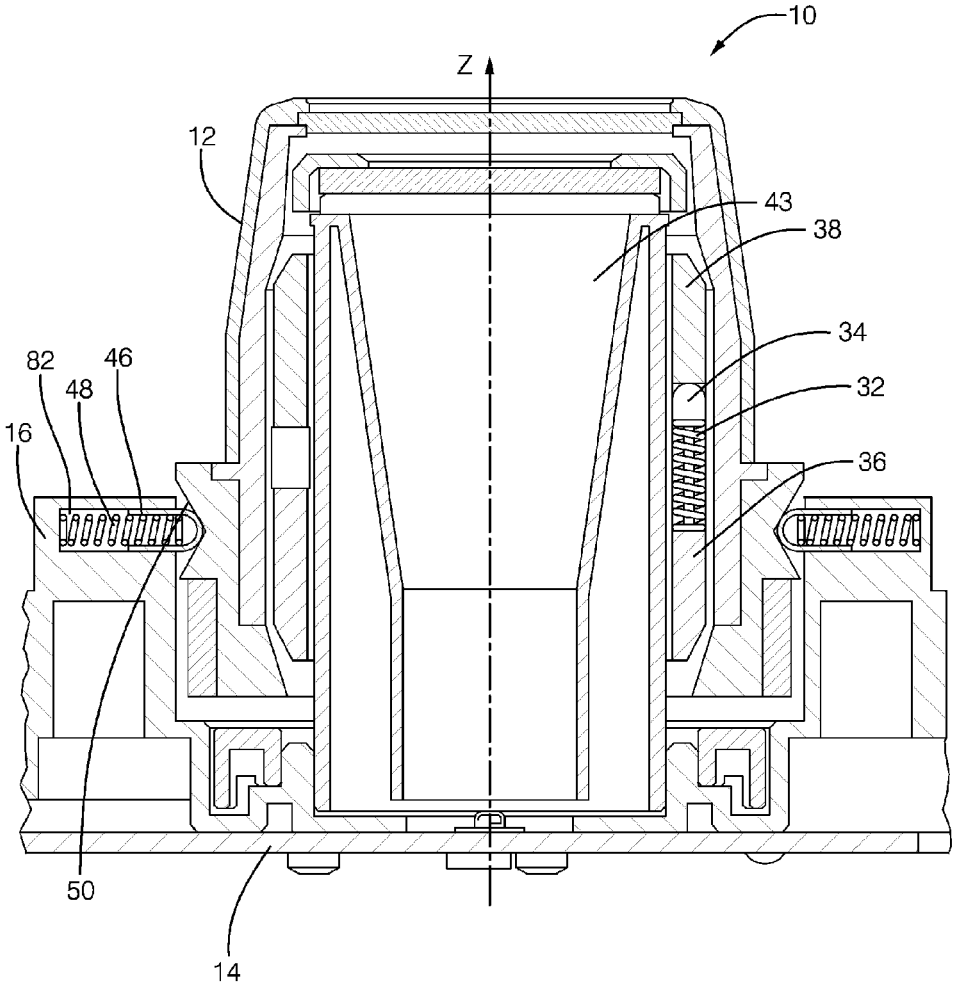
FIG. 4 is a section of the switch of FIG. 1, the section being in a vertical plan passing through guiding elements, the switch being in rest position.
Figure 5:
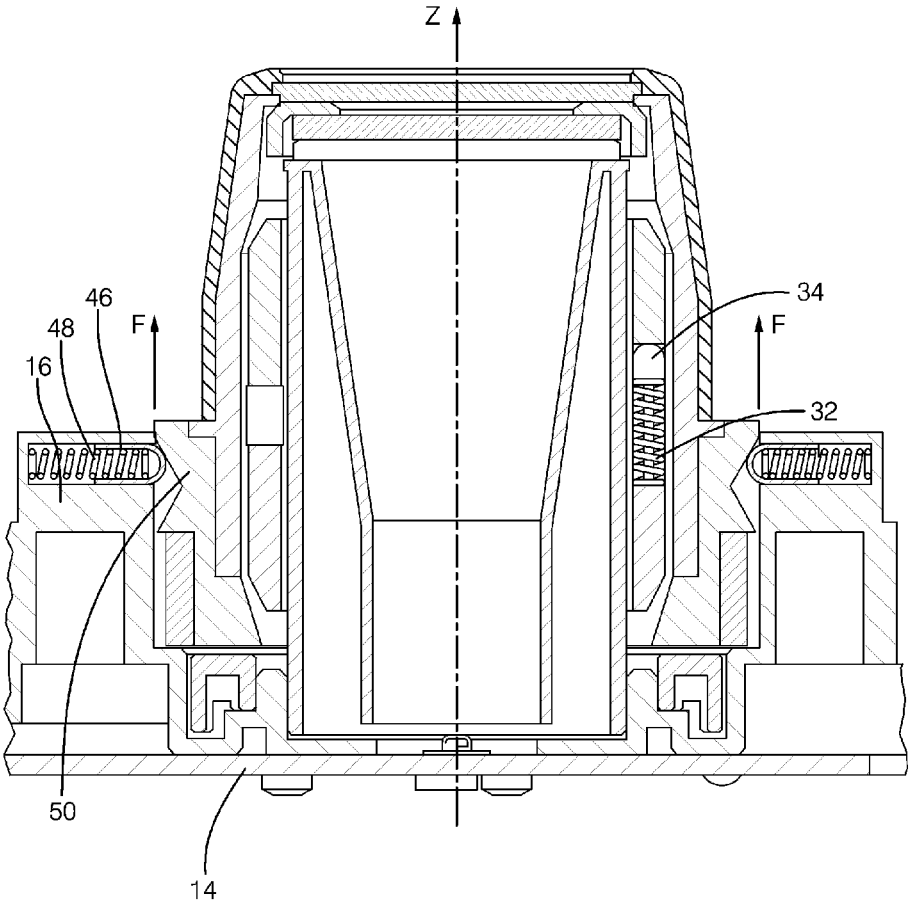
FIG. 5 is the same section as in FIG. 4, the switch assembly being in pushed position.
Figure 6:
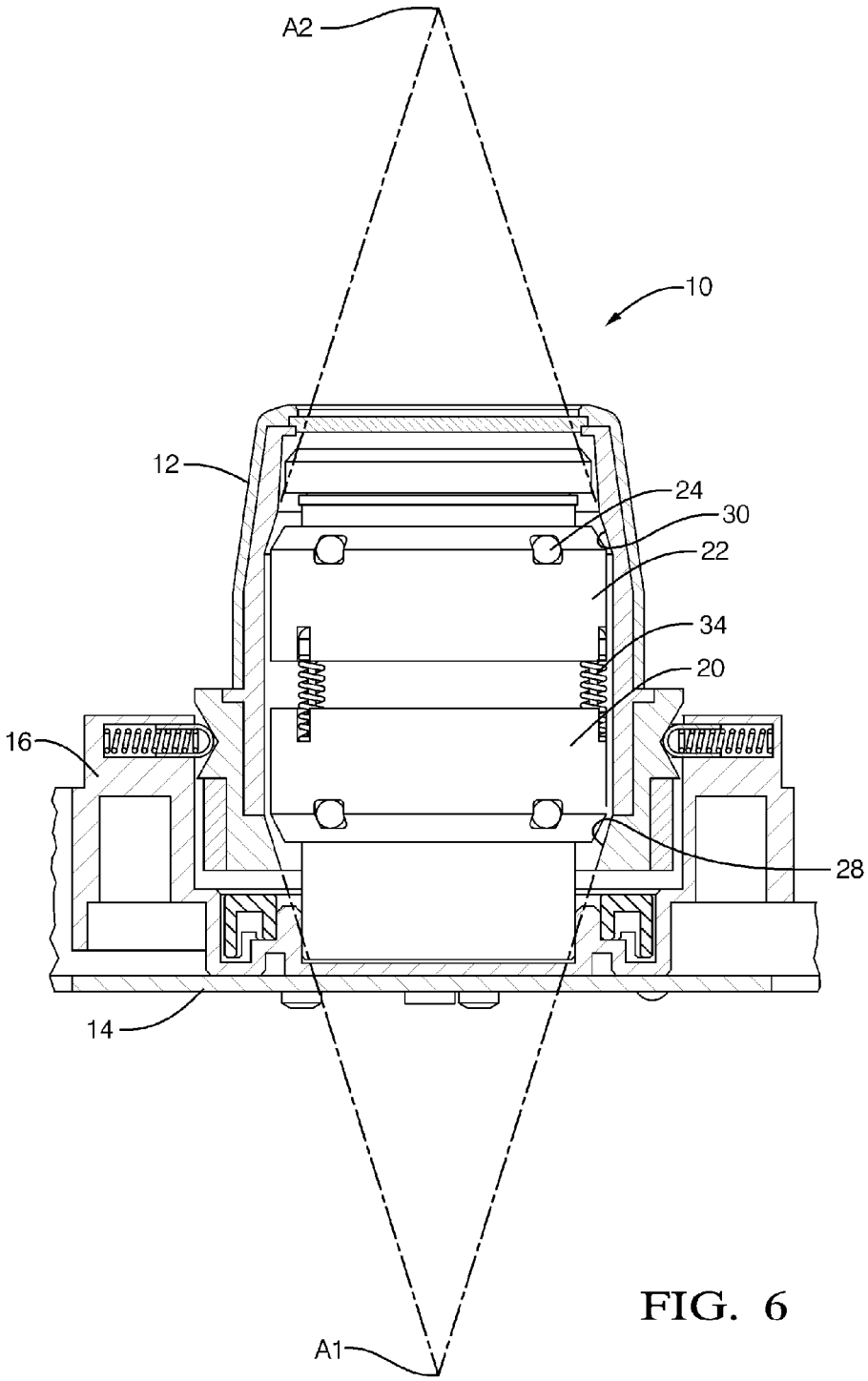
FIG. 6 is a section enabling to place the apex of truncated sectors.

The indexing device 44 present in the lower part of the knob 12 is particularly detailed on FIGS. 4 and 5. The support 16 receives in a horizontal recess 82 a coil spring 48 that biases the index 46 provided with a spherical end. Balls or other devices are known in the art to be used for similar purposes. The knob 12 is integrally provided on its periphery with the indented sector 50. Said sector 50 has indents comprised in vertical plans including the axis Z. Said indents also have a V-shape cross section, the axis of which is horizontal.

In the rest position P1—FIG. 4—the spherical end of the index 46 is biased against the bottom of the V. The force of the spring 48 is equally divided at the index 46 contacts in upward and downward vertical forces resulting in a vertical equilibrium having no influence on the knob's position. When moved away from the rest position P1, for instance when moved to the pushed position P2—FIG. 5—the knob 12 translates downward and so does the indented path 50. Consequently, the contact point of the index 46 moves upward to the upper branch of the V. This destroys the balance of vertical forces. Only upward forces F are generated pushing the knob 12 back up to the rest position P1.

The forces F applied are relatively low in the magnitude of few Newton's. An operator will have no difficulty to push the knob 12 commuting from the rest position P1 to the pushed position P2. Should the operator want; he would have no further difficulty to maintain the knob 12 in the pushed position P2. It is only when the knob 12 will be relieved that the upward forces F will return and maintain the knob 12 into the rest position P1.

Now are described some functional aspects of the switch assembly 10 as per the invention.

To achieve the above mentioned optimal functioning conditions, and considering the unavoidable variations of dimensions due for instance to manufacturing tolerances, humidity changes, expansion and contraction of material due to temperature variations, roundness imperfections, material composition, etc. . . . the optimum dimensioning of all components should accommodate proper functional gaps between the alignment features. For instance, the undercuts 35*a* should be slightly larger than the extensions 35*b*. Furthermore, these functional gaps should allow for a very slight tilt of the cages relative to each other thus compensating for all dimensional variations that will occur during the product life.

When assembled and not operated, the knob 12 remains in the rest position P1. The balls 24 are biased in the middle of their respective truncated outer races 28, 30, and consequently against their cylindrical inner races 25. The system is at equilibrium.

When the knob 12 is rotated, the balls 24 rotate on the inner race 25 and on the outer races 28, 30.

When the knob 12 is pushed, the upper and the lower bearings 20, 22, travel downward together with the knob 12. The distance between the cages 36, 38, does not change and the pre-load generated by the springs 32 does not change either. The travel distance being of very few millimeters, any friction of the balls does not affect the motion of the knob 12.

The invention claimed is:

1. A switch assembly formed by a coaxial assembly along a longitudinal axis of the switch, said switch comprising:

a cylindrical core axially extending from a core-base to a distal end, wherein the core-base is fixed to a base plate;

a knob extending from a knob-base to a distal knob-top, wherein the knob is axially rotatable about the cylindrical core;

a switching means for generating an electrical signal dependent on the rotations of the knob; and a guide means for guiding the knob in its motions relative to the core, said guide means comprising an upper-guide in the vicinity of the core-end and the knob-top, and a lower-guide in the vicinity of the core-base and the knob-base, wherein the upper-guide comprises rolling elements, said rolling elements configured to roll between an upper-guide inner race integral to the core, and an upper-guide outer race integral to the knob, wherein the outer race is truncated with upward apex, and wherein the switch assembly further comprises an upward bias means for generating an upward axial force biasing the rolling elements onto the upper-guide outer race.

2. The switch assembly set forth in claim 1, wherein the lower-guide comprises rolling elements rolling between a lower-guide inner race integral to the core and a lower-guide outer race integral to the knob.

3. The switch assembly set forth in claim 2, wherein the lower-guide outer race is truncated with a downward apex and the switch assembly further comprises a downward bias means for generating a downward axial force biasing the rolling elements onto the lower-guide outer race.

4. The switch assembly set forth in claim 3, wherein the upward bias means and the downward bias means for biasing the rolling elements are placed between the upper-guide and the lower-guide and are equally pushing apart said upper guide and said lower guide in opposite axial directions.

5. The switch assembly set forth in claim 4, said switch further comprising a coaxial alignment means for maintaining the coaxial alignment of the upper-guide with the lower-guide.

6. The switch assembly set forth in claim 1, wherein the knob is further configured to axially translate relative to the core between a first position and a second position, the means for guiding the knob in its motions relative to the core guiding the knob along the guide means when it translates, wherein the switch assembly further comprises another switching means for generating another electrical signal dependent on the axial translation of the knob.

7. The switch assembly set forth in claim 6 further comprising an axial force means for generating a unidirectional axial force onto the knob forcing said knob to return into the first position after being displaced from said first position.

8. The switch set forth in claim 1, wherein the knob-top is open or provided with a transparent means for providing visual access to a display fixed on a core-end.

9. The switch assembly set forth in claim 8, wherein the core is tubular and defines a hollow center configured to be a light channel for a light beam generated by a source, wherein the light beam backlights the display.

* * * * *